US011885116B2

(12) United States Patent
Herfurth et al.

(10) Patent No.: US 11,885,116 B2
(45) Date of Patent: Jan. 30, 2024

(54) PROFILE AND CONSTRUCTION ELEMENT SET FOR ARRANGING A COMPONENT FOR DRYWALL CONSTRUCTION, AND DRYWALL FORMED THEREWITH

(71) Applicant: Knauf Gips KG, Iphofen (DE)

(72) Inventors: Dominik Herfurth, Iphofen (DE); Robert Stubits, Vienna (AT); Sylvia Rachwitz, Erbach (DE); Michael Viebahn, Iphofen (DE)

(73) Assignee: Knauf Gips KG, Iphofen (DE)

( * ) Notice: Subject to any disclaimer, the term of this patent is extended or adjusted under 35 U.S.C. 154(b) by 0 days.

(21) Appl. No.: 16/762,567

(22) PCT Filed: Oct. 25, 2018

(86) PCT No.: PCT/EP2018/000488
§ 371 (c)(1),
(2) Date: May 8, 2020

(87) PCT Pub. No.: WO2019/091593
PCT Pub. Date: May 16, 2019

(65) Prior Publication Data

US 2020/0270857 A1 Aug. 27, 2020

(30) Foreign Application Priority Data

Nov. 13, 2017 (WO) ..... PCT/EP2017/001315

(51) Int. Cl.
*E04B 1/36* (2006.01)
*E04B 2/72* (2006.01)
(Continued)

(52) U.S. Cl.
CPC ..... *E04B 1/36* (2013.01); *E04B 2/721* (2013.01); *E04B 9/24* (2013.01); *E04C 3/30* (2013.01)

(58) Field of Classification Search
CPC ..... E04C 3/30; E04C 2003/0473; E04B 1/36; E04B 2/721; E04B 1/24; E04B 2/16;
(Continued)

(56) References Cited

U.S. PATENT DOCUMENTS 2,356,309 A * 8/1944 Garbe ..... E04B 1/24 52/390
3,332,197 A * 7/1967 Hinkle ..... E04C 3/06 47/33

(Continued)

FOREIGN PATENT DOCUMENTS

DE 20003618 U1 5/2000
EP 2333182 A1 6/2011

(Continued)

*Primary Examiner* — Jessie T Fonseca
(74) *Attorney, Agent, or Firm* — The Webb Law Firm

(57) ABSTRACT

The invention relates to a profile for arranging a component for a drywall construction, in particular a profile for a preferably ceiling-side fastening of a drywall, preferably a profile for a drywall comprising a panelled stud frame. Furthermore, the invention relates to a construction element set and to a drywall having such a profile. The invention provides a profile of the aforementioned generic type that can accommodate a possible relative movement of components of a drywall construction in an improved manner. This object is achieved according to the invention in that the profile has, in its cross section, substantially a U shape which comprises a web and two adjoining flanges, wherein the flanges are each designed to be resilient to the same degree and/or in the same manner in the direction which is substantially orthogonal to the web surface.

14 Claims, 4 Drawing Sheets

(51) Int. Cl.
*E04B 9/24* (2006.01)
*E04C 3/30* (2006.01)

(58) Field of Classification Search
CPC ..... E04B 2/7457; E04B 2/825; E04B 2/828; E04B 2001/2481
See application file for complete search history.

(56) References Cited

U.S. PATENT DOCUMENTS 3,841,051 A * 10/1974 Zinn ..... E04B 2/7457 52/747.1
4,002,000 A * 1/1977 Howard ..... B21D 47/01 52/842
4,058,951 A * 11/1977 Dean ..... E04B 2/58 52/656.1
4,216,635 A * 8/1980 Ratliff ..... B62D 33/042 29/428
4,760,682 A * 8/1988 King ..... E04B 1/2403 52/844
5,040,345 A 8/1991 Gilmour
5,471,805 A * 12/1995 Becker ..... E04B 2/7411 52/241
6,381,916 B1 * 5/2002 Maisch ..... E04B 2/7411 52/481.1
6,854,237 B2 * 2/2005 Surowiecki ..... E04B 2/7457 52/633
6,871,470 B1 * 3/2005 Stover ..... E04B 2/7457 403/109.1
7,451,573 B2 * 11/2008 Orszulak ..... E04B 2/767 52/167.1
7,735,295 B2 * 6/2010 Surowiecki ..... E04B 2/7457 52/831
8,074,416 B2 * 12/2011 Andrews ..... E04B 2/767 403/230
9,316,015 B1 * 4/2016 Elliott ..... E04H 9/14
10,851,821 B2 * 12/2020 de Goeij ..... E04F 13/08
2001/0004825 A1 * 6/2001 Menendez ..... E04C 3/07 52/846
2001/0017016 A1 * 8/2001 Rudduck ..... E04C 3/065 52/843
2004/0255543 A1 * 12/2004 Ubilla ..... E04C 3/36 52/831
2005/0126104 A1 * 6/2005 Erickson ..... E04C 3/09 52/633
2006/0032157 A1 * 2/2006 Baryla ..... E04B 2/7457 52/167.1
2007/0095002 A1 * 5/2007 Kim-Whitty ..... E04C 3/07 52/844
2007/0107325 A1 5/2007 Klein
2007/0125026 A1 * 6/2007 Frobosilo ..... E04B 2/767 52/481.1
2007/0193187 A1 * 8/2007 O'Connor ..... E04B 2/825 52/653.1
2007/0209306 A1 * 9/2007 Andrews ..... E04B 2/767 52/317
2008/0008345 A1 * 1/2008 Donaldson ..... E04B 9/06 381/386
2012/0174503 A1 * 7/2012 Milostic ..... E04B 2/7409 52/480
2013/0008740 A1 * 1/2013 Bean ..... E04B 2/789 181/290
2014/0165499 A1 * 6/2014 Vanker ..... E04C 3/07 29/897
2016/0215494 A1 * 7/2016 Pilz ..... E04B 2/7411
2017/0362847 A1 * 12/2017 Lopez ..... E04B 2/7457
2019/0316350 A1 * 10/2019 Pilz ..... E04B 1/941
2020/0048901 A1 * 2/2020 Schurig ..... E04B 2/7457

FOREIGN PATENT DOCUMENTS

FR 2863284 A1 6/2005
JP H11123458 A 5/1999
RU 171562 U1 6/2017
WO WO-9315353 A1 * 8/1993 ..... B21D 47/01
WO 2017101960 A1 6/2017

* cited by examiner

PROFILE AND CONSTRUCTION ELEMENT SET FOR ARRANGING A COMPONENT FOR DRYWALL CONSTRUCTION, AND DRYWALL FORMED THEREWITH

CROSS-REFERENCE TO RELATED APPLICATIONS

This application is the United States national phase of International Application No. PCT/EP2018/000488 filed Oct. 25, 2018, and claims priority to International Application No. PCT/EP2017/001315 filed Nov. 13, 2017, the disclosures of which are hereby incorporated by reference in their entirety.

BACKGROUND OF THE INVENTION

Field of the Invention

The invention relates to a profile for arranging a component for a drywall construction, in particular a profile for a preferably ceiling-side fastening of a drywall, preferably a profile for a drywall comprising a panelled stud frame. Furthermore, the invention relates to a construction element set and to a drywall having such a profile.

Description of Related Art

So-called sliding ceiling connections are known in drywall construction. A connecting element for a sliding ceiling connection is disclosed for example in U.S. Pat. No. 5,040,345.

The connecting element from the aforementioned publication has substantially a U-shape which can be inserted by one of its end sides, which shows the U-shape cross section, into a U-profile-shaped ceiling profile up to its U-profile web, that is to say against the ceiling, with the result that the U-profile-shaped connecting element is arranged transversely and thus perpendicularly to the U-profile-shaped ceiling profile. The upper end of a vertical stud of a stud frame of a drywall can be pushed onto the U shape of the connecting element in a sliding manner, or the U shape can be introduced into the upper end of the stud in a sliding manner. The free outermost end portions of the U-flanges of the U-profile of the connecting element can be screwed to the U-flanges of the ceiling profile, with the result that it is secured against a horizontal displacement in the ceiling profile. By contrast, the downwardly pointing width of the U-flanges of the connecting element predetermines a vertical sliding path for the upper end of the stud, which end can thus move correspondingly far from the U-web of the ceiling profile without coming completely free of the connecting element in the downward direction. In addition, for positive sliding guidance of the stud profile, the U-flanges of the connecting element have guide paths which are embodied as beads and in which the free longitudinal edges of a C-profile shape of the stud can engage in a positive manner. This positive engagement thus also prevents a horizontal movement of the stud, while it further allows a vertical movement.

For the case of ceiling sag or upward bending, connecting elements are used as so-called sliding ceiling connections in order, with the help thereof, to connect ceiling profiles to stud profiles in such a way that a vertical movement and change of spacing between the upper ends of the studs and the ceiling profiles can be allowed and tolerated. At the same time or thereby the connection between the studs and the ceiling profiles being prevented from being completely released and the studs no longer being fixed in the horizontal direction by their upper ends, which would result in an instability of the wall. Deflections of ceiling profiles and/or stud profiles can occur particularly in the event of fire with a large action of heat or in the case of shocks, for example earth tremors or other jolts, that is to say dynamically. In such cases, a secure connection between ceiling and wall should remain to avoid adverse effects or even injuries to persons and, in the event of fire, to prevent fire spreading as long as possible.

The sliding movement made possible by the connection means that the upper free end of the guided stud can be situated at a greater or lesser distance from the ceiling.

To form a drywall, the stud is usually panelled with panelling boards in one layer or two layers on one or on both sides. These boards can preferably contain gypsum as a constituent part, which can in particular also be suited for a fire protection. Especially for a fire situation, a sliding ceiling connection can indeed also be provided. However, if then the distance between the upper free end of the stud and the ceiling profile increases as a result of the sliding ceiling connection, the distance between the upper free edges of the panelling boards fastened to the stud and the ceiling also increases. This can result in an air-permeable gap which breaches the desired fire protection and, as a "weak point", facilitates and accelerates the transfer of fire.

A similar problem also arises if the drywall and its panelling boards are provided for noise protection since, hereto, a gap between ceiling and panelling boards can also breach the desired noise protection.

The object on which the invention is based is therefore to propose a profile of the generic type mentioned at the outset that can accommodate a possible relative movement of components of a drywall construction in an improved manner.

SUMMARY OF THE INVENTION

This object is achieved according to the invention by a profile for a ceiling-, floor- or wall-side fastening of a drywall that has substantially a U shaped cross section, the profile comprising a web and two adjoining flanges, wherein the flanges are each designed to be resilient to the same degree and/or in the same manner in the direction which is substantially orthogonal to the web surface.

This inventive solution makes it reliably possible in a surprisingly simple manner to allow a movement play between a ceiling and a panelling without breaching and weakening a fire protection and/or noise protection. Even in the event of movement, the respective U-profile flange of the profile according to the invention completely blocks the relatively small or large gap which is produced between ceiling and panelling. Generally, the movement play will only be a few centimetres. This can be defined by a corresponding spring deflection. Moreover, the use of a profile according to the invention can also be expedient and useful, for example, in the abutment region between two abutting walls, not only in the abutment region between a ceiling and a wall. The profile according to the invention could also be used advantageously, in particular in certain portions, for the floor-side connection of a wall element to a room floor. If, for example in the event of fire, a room ceiling drops down, this is compensated for by the profile according to the invention as ceiling profile. However, the dropped-down ceiling is possibly at the same time also the now dropped-down floor of the room above. Gaps can thus also occur in the floor region of the upper room, and these gaps could be compensated for by the profile used as floor profile. This is particularly advantageous in portions which are not loaded by excessive weight force of the wall elements, in particular thus for example in the region of door elements, for example with a profile according to the invention applied to a screed.

An embodiment of the invention is characterized by the spring action being achieved by in each case at least one bead which is incorporated into the respective flange and extends longitudinally substantially parallel to the web extent.

As a result, it is possible in a particularly favourable manner to predetermine an appropriate spring deflection through the shape and size of the bead and to ensure that the corresponding flange remains areally closed during the spring movement. A flexible material for the profile that allows the spring movement can be suitably selected, with a metal sheet constituting the material of choice.

A preferred embodiment of the profile according to the invention provides that the respective bead is formed substantially as an arcuate recessing of the flange material into the interior of the profile. The respective bead itself preferably has a substantially approximately V-shaped cross section.

A defined spring deflection can be set particularly well in this manner.

According to another embodiment of the invention the respective bead is formed approximately in the half of the effective flange depth that is adjacent to the web. As a result, the spring deflection is provided in a region in which it is required and in which it does not interfere with the panelling, which can be fastened in the region of the half of the flange that remains free.

What is to be understood here and in the following by the expression "effective flange depth" is the projection or the jutting of the flange from the web, including the channel width of the bead, wherein this effective flange depth is less than the material length of the flange that follows the extent of the bead or its lateral surface extent, that is to say the material length before the bead is incorporated. The profile could be produced, for example, by an extrusion process or by injection-moulding, but preferably by (multiple) folding of a flat material, in particular a metal sheet.

In the following it is intended, only by way of example, to mention some of the size ratios and parameters for embodiments of the profile according to the invention that could advantageously be taken into account for the design of the bead.

The channel width of the respective bead could preferably amount to approximately a third of the effective flange depth. The effective flange depth could preferably be approximately 50 to 70 mm, in particular approximately 60 mm, and the channel width of the bead could be approximately 15 to 25 mm, in particular approximately 20 mm.

The depth of the respective bead could preferably correspond to approximately a quarter of the effective flange depth. Given the aforementioned dimensions, the depth of the bead could be approximately 12 to 18 mm, in particular approximately 15 mm.

The depth of the respective bead could preferably correspond approximately to a quarter to a third of the web width. Given the aforementioned dimensions, the web width could be approximately 40 to 60 mm, in particular approximately 50 mm.

The effective flange depth could preferably be greater than or equal to the web width.

The effective flange depth could preferably be chosen to be approximately 20% greater than the web width.

Web widths which are particularly considered are preferably the dimensions which are used internationally, where appropriate according to national or regional or international standards, in drywall construction for stud frames. In Germany alone, there are currently, for example, also profiles with web widths of 75 mm, 100 mm, 125 mm and 150 mm. In other countries, there are additionally further profile dimensions still, for example a web width of 70 mm. Finally, according to the invention, the web width can be adapted in particular to the desired finished wall thickness, with the height or depth of the flange being adapted in particular to the required spring deflection.

The effective flange depth, as the flange depth projecting from the web after incorporating the bead, including the channel width of the bead, in relation to the original material length or material depth of the flange before incorporating the bead, that is to say including the lateral surface length of the bead, could preferably be approximately 3:4. Given the aforementioned dimensions, the material depth of the flange could be approximately 65 to 95 mm, in particular approximately 80 mm.

The depth of the bead could preferably be approximately ¾ of its channel width. This would correspond approximately to a bead apex angle of 67.4 angular degrees.

As has already been mentioned further above, the profile is preferably produced from a metal sheet. In particular, the metal sheet could have a thickness of approximately 0.6 mm. This thickness allows a good compromise between stability and spring properties.

According to a preferred embodiment of the invention the profile has one or more areas of material weakening along one or more kinks forming the bead. The material weakening areas can have the form of one or more recess bands extending lengthwise in the kinks forming the bead. For example, there can be a band of (elongate) holes, one after the other, formed within one or more of the kinks.

The material weakening areas in the kinks reduce the material stiffness and thus allow for a more easily deformation of the spring action. Thus, the resilience is reduced while the capability for deformation is enhanced. Expressed in other words, this means that the spring can be compressed more easily.

Alternatively, the area of material weakening can also be formed for example by thinning the materials thickness within the kinks. All other embodiments which achieve an enhanced compressibility of the profile's spring action are likewise useful.

Another development of the invention is characterized by the profile having substantially a box-shaped cross section by being formed from two profiles according to the invention, having substantially a U-shaped cross section, which profiles are nested with one another in such a way that the two U-profiles are pushed into one another with the free ends of their U-profile flanges leading.

This can serve advantageously for increasing and/or reinforcing the profile according to the invention while maintaining spring properties, for example for use in rather large, self-supporting ceilings. The U-profile flanges of the two U-profiles pushed into one another can preferably be fixedly connected to one another, for example by brazing or welding or riveting or using other, suitable means.

Independent protection is also claimed for a profile according to the invention for arranging a component for a drywall construction, which profile is provided as a ceiling profile for direct mounting on a ceiling, preferably as a ceiling profile for a ceiling-side fastening of a drywall, in particular a drywall comprising a panelled stud frame. This advantageously results, as already described above, in a movement play with a closed profile flange surface that counteracts neither a fire protection concept nor a noise protection concept, by contrast to a sliding ceiling connection.

In addition, the profile according to the invention can be provided with a fire protection material, preferably with a fire protection material which is intumescent in the event of fire, said material being applied, for example, as a varnish, coating or putty to the profile.

A profile according to the invention for arranging a component for a drywall construction, in particular, where appropriate, also a relatively short strand portion of such a profile, can particularly advantageously also be provided as a connecting member for the fastening of facing shells, in particular for directly fastened facing shells, or else for other correspondingly fastened drywall constructions.

Another embodiment of the profile according to the invention provides that the profile or in particular a strand portion of such a profile is designed and provided as a direct damping hanger or other spring bracket. This can preferably be associated with its use for fastening a facing shell.

Independent protection is also claimed for a construction element set for a drywall comprising a panelled stud frame, which construction element set is characterized by at least one spring profile according to the invention.

A preferred development of the construction element set according to the invention is particularly characterized by the web of the at least one spring profile being provided for connection to a ceiling or a wall and for fastening at least one panelling board to at least one of its profile flanges, wherein this profile flange blocks off a gap region between a free edge of the panelling board and the ceiling or the wall to prevent air passage. As already described further above, this avoids a weakening of a fire protection and/or a noise protection.

Although this is not absolutely necessary in the case of the spring profile according to the invention, according to an embodiment of the invention the construction element set can be characterized by the web of the spring profile being lined on the ceiling side or wall side with at least one strip of a panelling board material in order to predetermine an additional fire-protected region for a spring deflection, in particular if, as preferred according to a further embodiment, the fastening of the at least one panelling board to the profile flange is provided with an overhang of panelling board material that projects in the direction of the web. In the case of a ceiling connection, the overhang can preferably project approximately up to the web of the spring profile. In the case of a resilient compression of the spring profile, the upper free edge of the panelling overhang moves upwards beyond the plane of the web of the spring profile, it being possible for said required movement play to be provided above the web by the lining of the web with panelling board material. This results in a fire protection by the lining and the panelling which projects upwards in an overlapping manner as an apron or parapet. The lining can be chosen to be of such thickness and bulk that, even during a resilient stretching of the spring profile, this overlapping is still provided. As already mentioned further above, corresponding measures can also be used in an abutment region between two abutting walls.

In particular, provision can additionally be made for a fire protection material, preferably a fire protection material which is intumescent in the event of fire, to be arranged at least in the gap region between a free edge of the panelling board and the ceiling or the wall. Such an arrangement thus does not necessarily have to be carried out on the spring profile itself, but can also be provided in some other way in this region.

A preferred embodiment of the construction element set according to the invention is characterized by the panelling material containing gypsum. The at least one panelling board can preferably be a gypsum board, gypsum plasterboard or gypsum fibreboard. However, other panel materials known to the person of the art are also possible, chosen according to the intended use.

Independent protection is also claimed for a drywall according to the invention which is characterized in that it is built up from a construction element set according to the invention and/or comprises a profile according to the invention.

BRIEF DESCRIPTION OF THE DRAWINGS

Exemplary embodiments from which further inventive features can also result but which are to be regarded in principle merely as being by way of example and which are not intended to limit the subject matter of the invention or its scope of protection are illustrated in the drawings, in which.

DETAILED DESCRIPTION OF THE PREFERRED EMBODIMENTS

Figure 1:
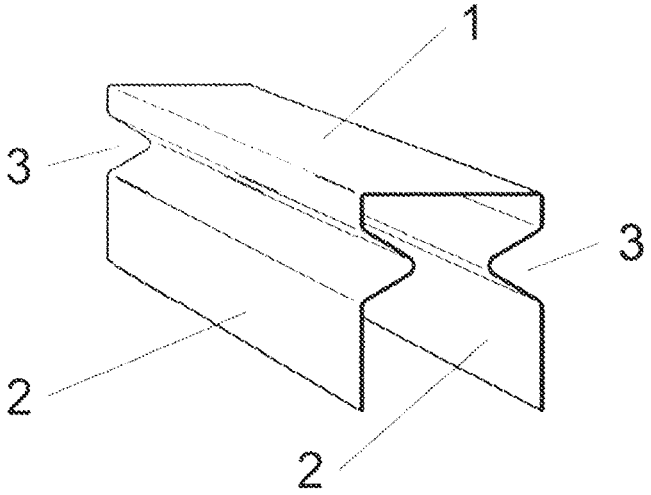
FIG. 1 shows a perspective view of a portion of a spring profile according to the invention, FIG. 1 *a*) shows a perspective view of portion of a spring profile having bands with recesses along the kinks forming the bead.
Figure 1A:
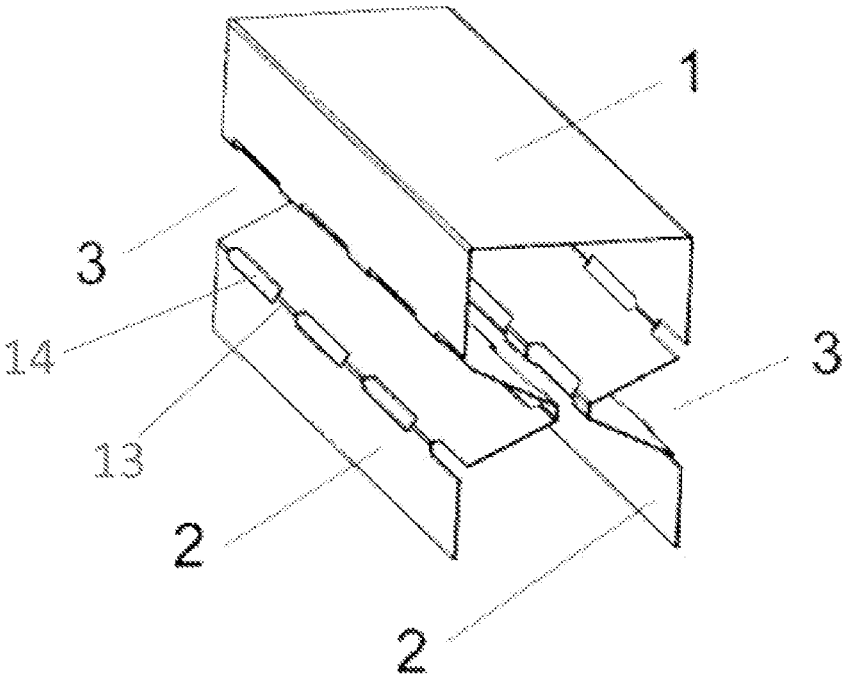

FIG. 1 shows a perspective view of a portion of a spring profile according to the invention.

The spring profile has substantially a U-shaped cross section which is formed from a web 1 and flanges 2 which project substantially parallel to one another therefrom. A bead 3 which has approximately a V-shaped cross section is arcuately recessed into each of the flanges 2.

These beads 3 allow a resilient stretching or shortening of the depth of the flanges 2. The spring profile is preferably produced from a metal sheet.

FIG. 1 *a*) shows a perspective view of portion of a spring profile having bands with recesses 14 along the kinks 13 forming bead 3. The recesses 14 are a series of elongate holes which are positioned within the fold of the kinks 13. The recesses weaken the material strength in the kinks and thus make the flanges react more elastic to forces acting in a direction perpendicular to the web's area. The springiness of the profile in enhanced.

Figure 2:
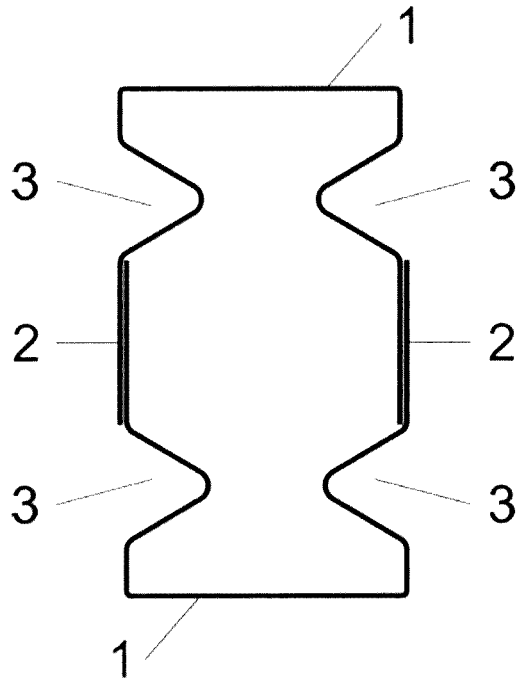
FIG. 2 shows a cross section or an end view of a box-shaped spring profile according to the invention as a second exemplary embodiment of a spring profile according to the invention which is formed from two nested-together spring profiles according to FIG. 1.

FIG. 2 shows an end view of a second exemplary embodiment of a spring profile according to the invention. The cross section of this spring profile is substantially box-shaped or rectangular. This box shaped profile consists of two spring profiles according to FIG. 1 which are plugged into one another and nested with one another. In FIG. 2 and in the remaining figures, identical components are designated with the same reference numbers as in FIG. 1.

The flanges 2 of the two U-profiles can additionally be fixedly connected to one another in their overlapping region, see description above.

Figure 3:
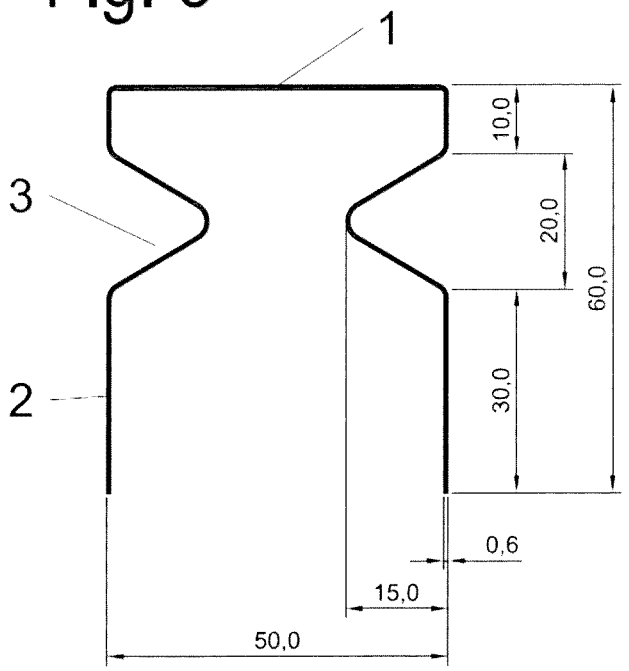
FIG. 3 shows an end view of the spring profile according to FIG. 1 with examples of dimensions, FIGS. 4 *a*), *b*), *c*) show sectional views of a vertical section with spring phases of a spring profile according to the invention as shown in FIG. 1 as a ceiling profile of a drywall, FIGS. 5 *a*), *b*), *c*) show sectional views of a vertical section with spring phases of a spring profile according to the invention as shown in FIG. 1 as a ceiling profile of a drywall, corresponding to FIGS. 4 *a*), *b*), *c*), with a lining of the spring profile.

FIG. 3 shows the spring profile according to FIG. 1 with examples of dimensions given.

Figure 4:
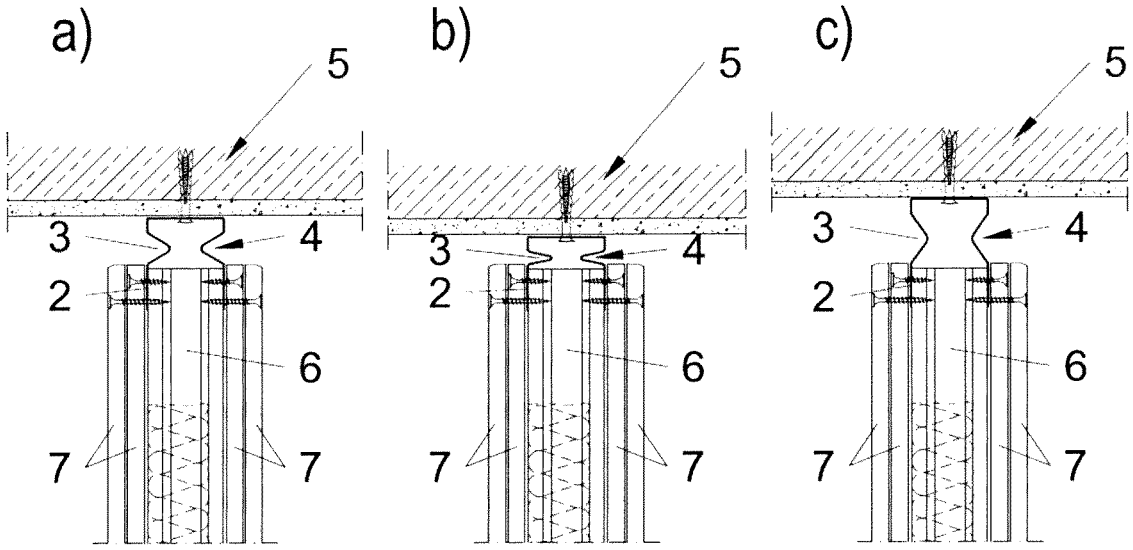

FIGS. 4 *a*), *b*) and *c*) show sectional views of a respective vertical section with different spring phases of a spring profile according to the invention as shown in FIG. 1 as a ceiling profile of a drywall.

The spring profile 4 is illustrated in the unloaded state in FIG. 4 *a*), whereas it is compressed in FIG. 4 *b*) and pulled apart in FIG. 4 *c*). As a result, the shape of the bead 3 and the effective depth of the respective flange 2 change in each case.

The spring profile 4 according to the invention is screwed directly to a ceiling 5 as ceiling profile. The ceiling 5 can be of multi-layered design.

The spring profile 4 provides a connection between the ceiling 5 and a drywall comprising a stud frame 6 having in this example double-layered panellings on both sides in the form of panelling boards 7. In this example the panelling boards are gypsum fibreboards.

It can be seen in particular in FIG. 4 that the spring profile 4, independent of the spring phase, does not open up an air passage gap between the ceiling 5 and the panelling boards 7 and thus does not breach a fire protection or a noise protection.

For the sake of completeness, it should be mentioned at this point that the illustrations of FIGS. 4, if turned upside down, would represent conditions of how a profile according to the invention would appear and could be used if it were correspondingly used for connecting a wall at the base point thereof to a room floor.

Figure 5:
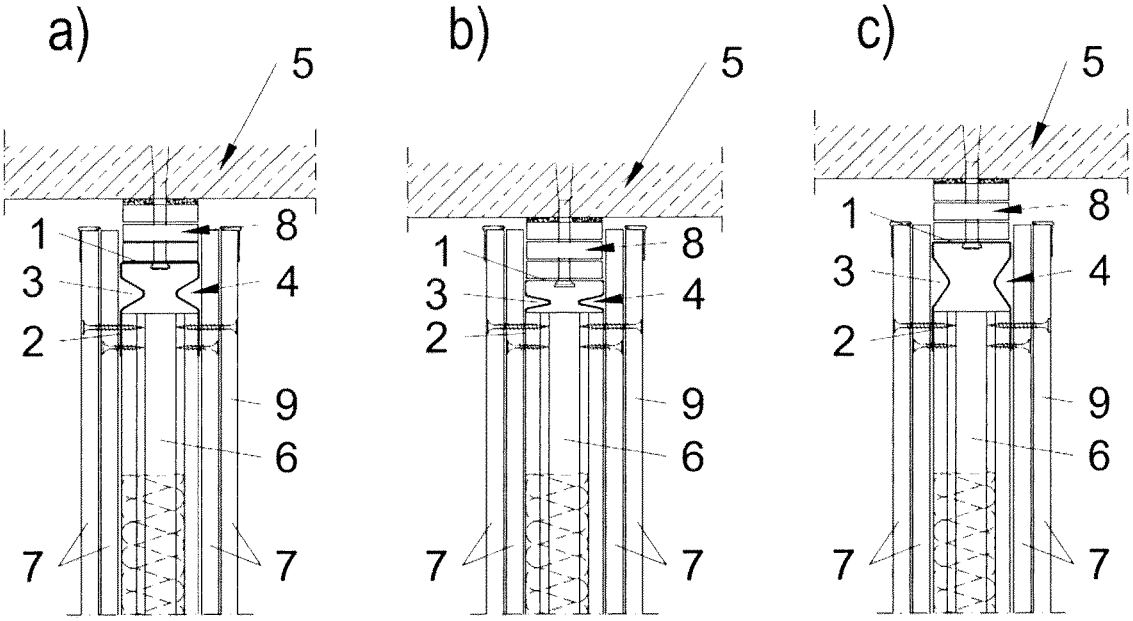

FIGS. 5 *a*), *b*) and *c*) show sectional views of a respective vertical section with different spring phases of a spring profile 4 according to the invention, corresponding to FIGS. 4 *a*), *b*) and *c*), with the same reference numbers.

By contrast to FIGS. 4, the spring profile 4 in FIG. 5 is provided with a multi-layered lining of panelling board strips 8 between its web 1 and the ceiling 5. In addition, the panelling boards 7 have overhangs 9 which project upwardly beyond the web 1. These overhangs 9 form, as fire protection aprons, together with the panelling board strips 8, an additional labyrinth for reinforcing the fire and/or noise protection in this region. Here, the movement play between the upper edges of the panelling boards 7 and the ceiling 5 is defined by the thickness of the panelling board strips 8, specifically being coordinated with the spring deflection of the beads 3 and the height of the overhangs 9.

Figure 6:
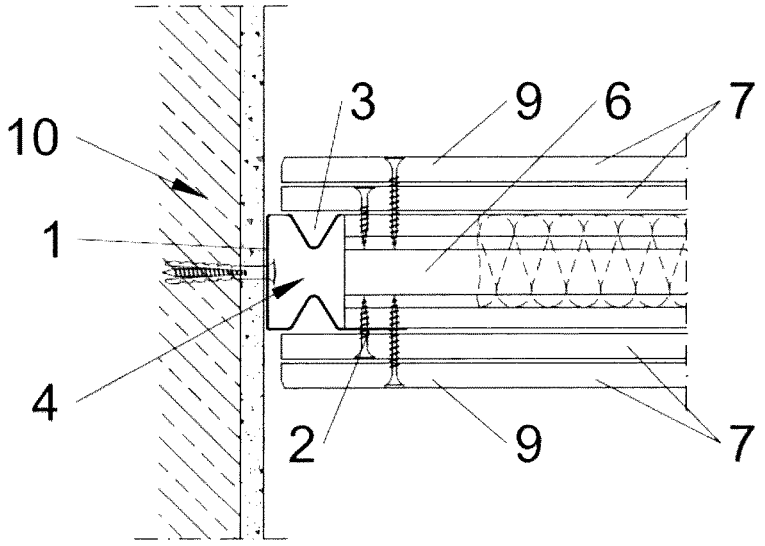
FIG. 6 shows a sectional view of a horizontal section of a spring profile according to the invention as shown in FIG. 1 as a wall connection profile of a drywall in the abutment region with a wall.

FIG. 6 shows a sectional view of a horizontal section of a spring profile 4 according to the invention as shown in FIG. 1 as a wall connection profile of a drywall in the abutment region with a wall 10.

The illustration of FIG. 6 substantially corresponds to the illustration of FIG. 4 *a*) or 5 *a*), with the wall 10 replacing the ceiling 5 and, correspondingly, the spring profile 4 and the illustration being differently oriented.

Figure 7:
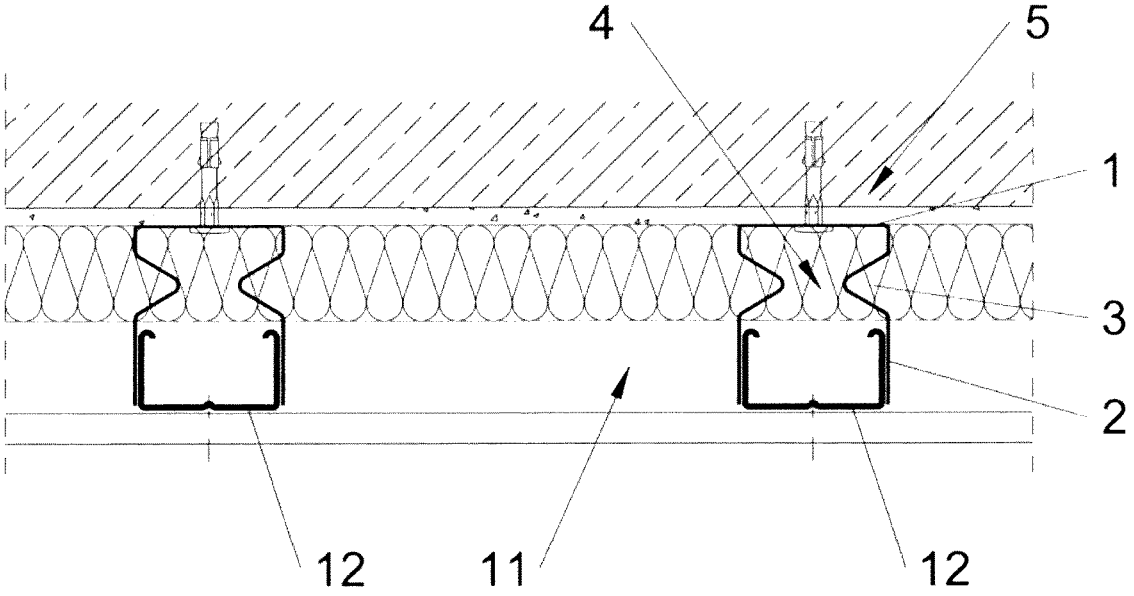
FIG. 7 shows a sectional view of a vertical section with spring profiles according to the invention as direct damping hangers for a suspended facing shell on a ceiling.

FIG. 7 shows by way of example a sectional view of a vertical section with spring profiles 4 according to the invention as direct damping hangers for a suspended facing shell 11 of multi-layered design on a multi-layered ceiling 5.

It also possible to use only short portions of a profile strand as direct damping hangers that are arranged on U-shaped ceiling profiles 12 of the facing shell 11 that continue or extend further.

The invention claimed is:

1. A profile for arranging a component for a drywall construction, wherein the profile comprises a first profile and second profile, wherein each of the first profile and the second profile have, in a cross section substantially a U-shape which comprises a web and two adjoining resilient flanges, wherein the resilient flanges are each designed to be resilient to the same degree and/or in the same manner in the direction which is substantially orthogonal to a surface of the web, and the resilient flanges each including a first linear portion proximate to the web and a second linear portion distal from the web, wherein at least one bead is intermediate to the first linear portion and the second linear portion, the at least one bead extending longitudinally substantially parallel to a web extent comprising one or more areas of material weakening in the form of one or more recess bands, along one or more kinks forming a respective bead, and wherein the profile, in a cross section, has a substantially box-shaped cross section by being formed from the first profile and the second profile and the first and second profiles are nested with one another in such a way that the first and second profiles are pushed into one another with the resilient flanges leading, and wherein the second linear portion of the resilient flanges of the first and second profiles contact one another when pushed into one another and the web surfaces, the resilient flanges, and the beads directly face one another and towards an interior of the substantially box-shaped cross section.

2. The profile according to claim 1 wherein the respective beads are formed substantially as an arcuate recessing of a material of the respective resilient flange into the interior of the profile.

3. The profile according to claim 1 wherein the respective beads are formed such that the first linear portions and the second linear portions are equal in length.

4. The profile according to claim 1 wherein a depth of the respective beads corresponds to approximately a quarter to a third of a width of the web.

5. The profile according to claim 1 wherein a depth of one of the resilient flanges from the respective web, incorporating a width of the respective bead, in relation to the depth of the one of the resilient flanges before incorporating the respective bead has a ratio of approximately 3:4.

6. The profile according to claim 1, wherein the profile being provided as a ceiling profile for direct mounting on a ceiling.

7. The profile according to claim 1, wherein the profile being provided as a connecting member for the fastening of a facing shell.

8. The profile according to claim 6, wherein the ceiling profile is configured for a ceiling-side fastening of a drywall.

9. The profile according to claim 8, wherein the drywall comprises a panelled stud frame.

10. A construction element set for a drywall comprising a panelled stud frame including at least one profile according to claim 1.

11. The construction element set according to claim 10, wherein the web of the at least one profile being provided for connection to a ceiling, a wall or a floor and for fastening at least one panelling board to at least one of the resilient flanges, wherein the at least one of the resilient flanges blocks off a gap region between a free edge of the at least one panelling board and the ceiling, the wall or the floor to prevent air passage.

12. The construction element set according to claim 11, wherein the web of the at least one profile is being lined on the ceiling, wall or floor with at least one strip of the at least one panelling board.

13. The construction element set according to claim 11, wherein a fastening of the at least one panelling board to the at least one of the resilient flanges is being provided with an overhang of the at least one panelling board that projects in the direction of the web.

14. A drywall, the drywall being fastened to the construction element set according to claim 10.

* * * * *